US006373448B1

(12) United States Patent
Chun

(10) Patent No.: US 6,373,448 B1
(45) Date of Patent: Apr. 16, 2002

(54) ANTENNA FOR BROADBAND WIRELESS COMMUNICATIONS

(75) Inventor: Ki Chun, Lehi, UT (US)

(73) Assignee: Luxul Corporation, Salt Lake City, UT (US)

( * ) Notice: Subject to any disclaimer, the term of this patent is extended or adjusted under 35 U.S.C. 154(b) by 0 days.

(21) Appl. No.: 09/834,746

(22) Filed: Apr. 13, 2001

(51) Int. Cl.[7] ..... H01Q 1/36
(52) U.S. Cl. ..... 343/895
(58) Field of Search ..... 343/895; H01Q 1/36

(56) References Cited

U.S. PATENT DOCUMENTS

| | | | | |
|---|---|---|---|---|
| 4,014,028 | A | 3/1977 | Cone et al. | 343/895 |
| 4,862,184 | A | 8/1989 | Ploussios | 343/745 |
| 5,329,287 | A | 7/1994 | Strickland | 343/752 |
| 5,479,182 | A | * 12/1995 | Sydor | 343/895 |
| 5,572,172 | A | 11/1996 | Stanke et al. | 333/128 |
| 5,594,461 | A | 1/1997 | O'Neill, Jr. | 343/895 |
| 5,612,707 | A | 3/1997 | Vaughan et al. | 343/895 |
| 5,635,945 | A | 6/1997 | McConnell et al. | 343/895 |
| 5,708,448 | A | 1/1998 | Wallace | 343/895 |
| 5,790,080 | A | 8/1998 | Apostolos | 343/744 |
| 5,793,338 | A | 8/1998 | Standke et al. | 343/895 |
| 5,828,348 | A | 10/1998 | Tassoudji et al. | 343/895 |
| 5,835,065 | A | 11/1998 | Wallace et al. | 343/702 |
| 5,872,549 | A | 2/1999 | Huynh et al. | 343/895 |
| 5,896,113 | A | 4/1999 | O'Neill, Jr. | 343/895 |
| 5,909,196 | A | 6/1999 | O'Neill, Jr. | 343/895 |
| 5,920,292 | A | 7/1999 | O'Neill, Jr. | 343/895 |
| 5,923,305 | A | 7/1999 | Sadler et al. | 343/895 |
| 5,945,963 | A | 8/1999 | Leisten | 343/895 |
| 5,986,621 | A | 11/1999 | Barts et al. | 343/895 |
| 6,002,377 | A | 12/1999 | Huynh et al. | 343/895 |
| 6,052,089 | A | 4/2000 | Eggleston | 343/702 |
| 6,094,178 | A | 7/2000 | Sanford | 343/895 |
| 6,133,891 | A | 10/2000 | Josypenko | 343/895 |
| 6,181,295 | B1 | 1/2001 | Sharaiha et al. | 343/895 |

OTHER PUBLICATIONS

John D. Kraus, *Antennas,* published by McGraw–Hill, 1988, 2nd edition, Chapter 7, pp. 265 to __.

* cited by examiner

*Primary Examiner*—Michael C. Wimer
(74) *Attorney, Agent, or Firm*—Stoel Rives LLP

(57) ABSTRACT

A helical antenna includes an elongate core attached to a back plate, and a radiating element in the shape of a helix that rests in a helical groove formed in an exterior major surface of the elongate core. The helical antenna further has an impedance matching section, with a narrow end and a wide end, that is seated in the helical groove at a predetermined distance from the back plate and connected to the radiating element at the narrow end of the impedance matching section.

12 Claims, 3 Drawing Sheets

ANTENNA FOR BROADBAND WIRELESS COMMUNICATIONS

TECHNICAL FIELD

The invention relates to helical antennas and, in particular to helical antennas for use in wireless communications, having an improved impedance matching section.

BACKGROUND OF THE INVENTION

Antennas are a basic component of all systems using electromagnetic radiation to transmit and receive information. Many types of antennas exist, ranging from a single monopole antenna to complicated antenna arrays. Each type of antenna has its own strengths and weaknesses, making the selection of the appropriate type of antenna for a system dependent upon the performance and frequency range requirements of the system.

In some systems, the frequency range and properties of axial mode helical antennas are beneficial. Helical antennas typically have a radiating element (an electrical conductor of some sort) in the shape of a helix, which is attached to some sort of back plate, and which is connected to a signal generator, or radio. Helical antennas, unlike other types of antennas, emit and respond to electromagnetic radiation with a circular polarization. This polarization can be either left- or right-hand polarization depending upon the orientation of the helically shaped radiating element. This characteristic can help reduce problems due to multipath signals because a reflected signal typically will be the opposite polarization from the original. This cross polarization will typically produce up to a 20 dB attenuation in the reflected signal. Due to this drop in signal strength the multipath signal will typically be treated as noise and disregarded.

Typically, helical antennas are employed in systems involving satellite communication with Earth-based stations. The frequency range and other attributes of a helical antenna depend upon the physical characteristics of the antenna, such as the radius of the helix, the distance between turns on the helix, and the pitch angle of the helix. Ideally, the length of a single turn of the helix should be around the peak wavelength in which the antenna transmits and receives. Furthermore, the gain of the antenna is roughly proportional to the overall length of the antenna, while the beam width of the antenna is roughly inversely proportional. A typical open-air axial mode helical antenna for the 2.4 GHz Industrial, Scientific, Medical frequency band (hereinafter "ISM band") will be around 1.5 inches (3.81 cm) in diameter with the length dependant upon desired gain and beam width. The exact frequency range for the ISM band varies from county to country, but is typically about 2.4 GHz to 2.5 GHz.

It is known in the art that these dimensions can be effectively reduced by loading the helical antenna with a dielectric substance at the center of the radiating element. In this manner, an effective helical antenna for the ISM band can be around 1 inch (2.54 cm) in diameter and with the length varying based on the desired beam width and gain, depending upon the dielectric constant of the substance used. This reduction in the size of the antenna makes helical antennas a feasible option in a wider range of wireless communications environments.

Typically, the electrical impedance of the helical antenna's radiating element will differ from the electrical impedance of the electrical connector for a supply network (i.e., connector for a signal generator, or a radio, etc.) to be used with the antenna. To accommodate this difference in electrical impedance, the helical antenna must typically include an impedance matching network at an interface between the radiating element and the electrical connector for the supply network in order to prevent signal reflection, or loss, at that interface. Matching networks are well known in the art, as are other solutions to the impedance matching problem. A typical matching network may consist of an electrical circuit printed on a flexible substrate mounted near the back plate of the helical antenna. A first end of this matching network is connected to the antenna's radiating element and matches the electrical impedance of the antenna's radiating element at the first end. A second end of the matching network is connected to the electrical connector for the supply network and matches the electrical impedance of the connector at the second end.

An alternative to the above matching network is a matching section comprising a tapered piece of metal that has a length of approximately one-quarter of the antenna's operative wavelength. This matching section tapers from approximately the width of the radiating element, at the end connected to the radiating element, to a width that provides an appropriate impedance for the particular electrical connector for the supply network, at the end connected to the electrical connector. This type of impedance matching section is typically affixed near the proximal end of the cylinder supporting the helix. The prior art affixes the matching section in a manner that leaves the matching section vulnerable to stresses exerted by the connector for the supply network as well as by the radiating element (including any stress associated with a structure supporting the radiating element). Tension exerted on the matching section by the connector for the supply network and by the radiating element can often be sufficient to distort the matching section's shape. This distortion can render the matching section inoperative or less effective, resulting in signal reflection and loss at the interface with the antenna's radiating element and/or at the interface with the electrical connector for the supply network. Thus, a need exists for an improved matching section that is less susceptible to distortion from stress exerted by the connector for the supply network or by radiating element.

SUMMARY OF THE INVENTION

The present invention relates to a helical antenna in which a radiating element, formed into a helix, rests on an elongate core and connects to an impedance matching section at the proximal end of the elongate core for matching the impedance of the radiating element to the impedance of an electrical connector that serves to connect the antenna to a radio. The elongate core is mounted to a back plate, which is adapted for mounting the antenna to a support structure. The impedance matching section is seated in a helical groove in an exterior major surface of the elongate core adjacent to the proximal end of the elongate core, thereby providing additional anchoring and structural support to the impedance matching section. This additional structural support renders the improved matching section less susceptible to mechanical stress imparted by the connector for the supply network or by the cylinder and the helix.

Additional aspects and advantages of this invention will be apparent from the following detailed description of preferred embodiments thereof, which proceeds with reference to the accompanying drawings.

DETAILED DESCRIPTION OF PREFERRED EMBODIMENTS

Figure 1:
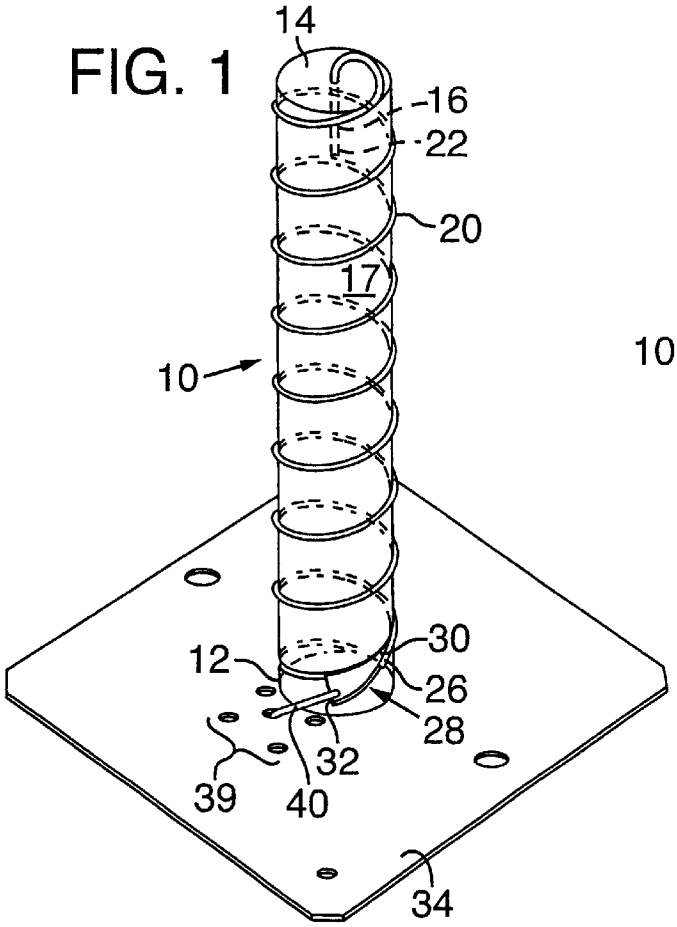
FIG. 1 is a perspective view of a helical antenna in accordance with a first preferred embodiment of the present invention.

FIG. 1 is a perspective view of an axial mode helical antenna 8 in accordance with a first preferred embodiment of the present invention. With reference to FIG. 1, helical antenna 8 includes an elongate core 10 that has a proximal end 12, a distal end 14, a first hole 16 in distal end 14, an exterior major surface 17, and a helical groove 42 (FIG. 2*b*) in exterior major surface 17 extending between proximal end 12 and distal end 14. A radiating element 20 rests is helical groove 42 (FIG. 2*b*) and has a first end 22, which is inserted into first hole 16, and a second end 26 which connects to an electrical impedance matching section 28. Impedance matching section 28 has a narrow end 30 and a wide end 32, and is seated in helical groove 42 (FIG. 7) adjacent to proximal end 12 of elongate core 10. Wide end 32 or impedance matching section 28 is positioned at a predetermined distance from a back plate 34, to which proximal end 12 of elongate core 10 is attached. Hole arrangement 39 is provided for attaching an electrical connector 40 to back plate 34. Wide end 32 of impedance matching section 28 is connected to connector 40 for coupling radiating element 20 to a to a supply network (not shown). Narrow end 30 of impedance matching section 28 is connected to radiating element 20 proximal to second end 26 of radiating element 20.

In a presently preferred embodiment, elongate core 10 is a cylindrical dielectric rod having a diameter, a length, and a dielectric constant. Elongate core 10 is preferable made of either Delrin (an acetal resin), general purpose (GP) nylon, or any other dielectric material with a dielectric constant of approximately 3.6. The diameter of the preferred embodiment of elongate core 10 will depend upon the desired frequency response of helical antenna 8 and the dielectric properties of elongate core 10. In the case in which elongate core 10 is made of general purpose nylon, and the desired frequency response is in the ISM band, the diameter of elongate core 10, is preferably between 1.2 and 1.3 inches (3.048 and 3.302 cm). The length of elongate core 10 is determined by the desired number of turns in the helix formed by radiating element 20. As mentioned above, the gain of helical antenna 8 is roughly proportional to the length of helical antenna 8. In addition, the beam width of helical antenna 8 is roughly inversely proportional to the length of helical antenna 8. Preferred lengths of helical antenna 8 correspond to 7-turn antennas, 10-turn antennas, 12-turn antennas, 17-turn antennas, and 20-turn antennas. In this embodiment, the helix formed by radiating element 20 has a flight spacing between turns in the helix ranging between 0.861 and 0.871 inches (2.187 and 2.212 cm). The helix has a pitch angle between 12 and 13 degrees.

Figure 2B:
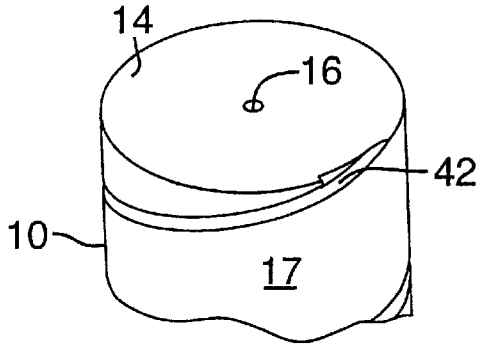
FIG. 2*b* is an enlarged partial perspective view of the distal end of the helical antenna of FIG. 1 with the radiating element omitted to show the detail of the elongate core.
Figure 2A:
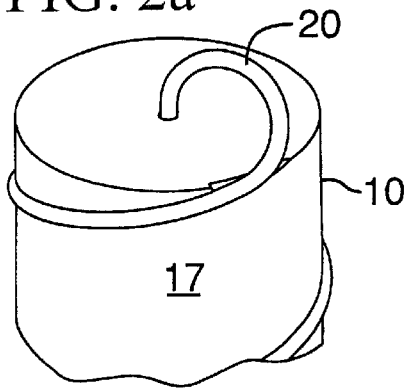
FIG. 2*a* is an enlarged partial perspective view of a distal end of the helical antenna of FIG. 1 showing a radiating element wound about an elongate core of the helical antenna.

FIG. 2*a* is an enlarged partial view of distal end 14 of helical antenna 8 of FIG. 1, showing radiating element 20 wound about elongate core 10. With reference to FIG. 2*a*, radiating element 20 rests in helical groove 42. First end 22 of radiating element 20 is inserted into first hole 16 in distal end 14 of elongate core 10. First end 22 is inserted into first hole 16 in this manner to minimize termination effects caused by first end 22 (terminal end) of radiating element 20. In a presently preferred embodiment of the invention, radiating element 20 comprises lacquered copper wire and has a radius of about 0.0175 inches (0.04445 cm) and a radiating element impedance of approximately 110 ohms.

FIG. 2*b* is an enlarged partial perspective view of distal end 14 of helical antenna 8 of FIG. 1 with radiating element 20 omitted to show the detail of elongate core 10. With reference to FIG. 2*b*, helical groove 42 in elongate core 10 extends between distal end 14 and proximal end 12 (FIG. 1). Distal end 14 includes first hole 16, into which first end 22 of radiating element 20 is inserted (FIG. 2*a*). Typically, helical groove 42 has a semicircular cross section with a radius approximately equal to the radius of radiating element 20, but other groove shapes may be used, e.g. a rectangular, square or v-shaped groove. In a preferred embodiment of the present invention, helical groove 42 is machined into exterior major surface 17 of elongate core 10 and has a radius of about 0.0175 inches (0.04445 cm). However, an alternative embodiment of the present invention (not shown) could utilize a nonuniform groove, such that the depth of the groove relative to exterior major surface 15 of elongate core 10 is relatively greater at proximal end 12, to allow for more structural support of impedance matching section 28.

Figure 4:
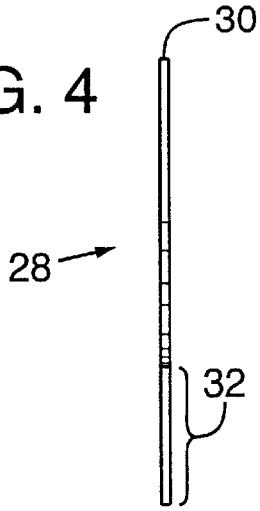
FIG. 4 is a side elevation view of the impedance matching section of FIG. 3.
Figure 3:
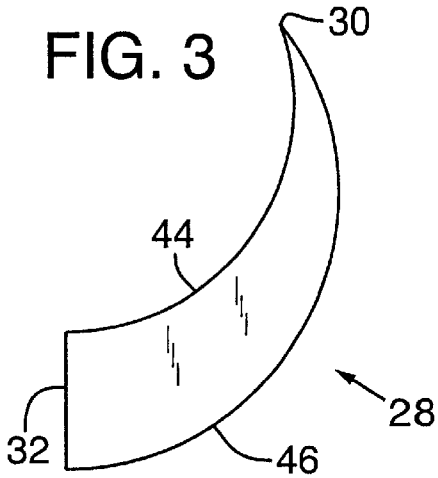
FIG. 3 is a top plan view of an impedance matching section of the helical antenna of FIG. 1.

FIGS. 3 and 4 are respective top plan and side elevation views of impedance matching section 28. With reference to FIG. 3 and FIG. 4, impedance matching section 28 comprises a second material, preferably an electrically conductive material such as copper, and has narrow end 30, wide end 32, a shape, and a thickness. Impedance matching section 28 tapers out from narrow end 30 to wide end 32. In a presently preferred embodiment, the shape is such that narrow end 30 has a narrow end impedance and wide end 32 has a wide end impedance. The narrow end impedance at narrow end 30 of matching section 28 will typically be equivalent to the radiating element impedance at second end 26 of radiating element 20. The wide end impedance at wide end 32 of impedance matching section 28 will typically be equivalent to a connector impedance of connector 40. In a presently preferred embodiment, impedance matching section 28 comprises a piece of copper with narrow end 30, in which the narrow end impedance is approximately 110 ohms. Impedance matching section 28 further comprises wide end 32, in which wide end impedance is approximately 50 ohms. An exact impedance match is not necessary, and in practice is typically not possible. A greater discrepancy between the radiating element impedance and the narrow end impedance and between the wide end impedance and the connector impedance will result in a less efficient helical antenna. Typically, a 96% efficiency is acceptable, which corresponds to a voltage standing wave ratio (VSRW) of about 1.5:1.

In a presently preferred embodiment, impedance matching section 28 is bounded by an inner arcuate margin 44 and an outer margin 46. Inner arcuate margin 44 is approximately the same shape as helical groove 42, such that inner arcuate margin 44 can be seated into helical groove 42. Outer margin 46 flares out from narrow end 30 of impedance matching section 28 to wide end 32 of impedance matching section 28. Inner arcuate margin 44 of impedance matching section 28 may also be a portion of a circle with a radius of approximately 0.625 inches (1.588 cm), while outer margin 46 of impedance matching section 28 is a portion of the circumference of a circle with a radius of approximately 0.750 inches (1.905 cm), and wide end 32 of impedance matching section 28 has a length of approximately 0.375 inches (0.953 cm). In this embodiment impedance matching section 28 has a thickness, as shown in FIG. 4, and that thickness is approximately 0.025 inches (0.0635 cm). The tolerances typically applicable to the above dimensions of the impedance matching section are plus or minus 0.005 inches (0.0127 cm).

Figure 5:
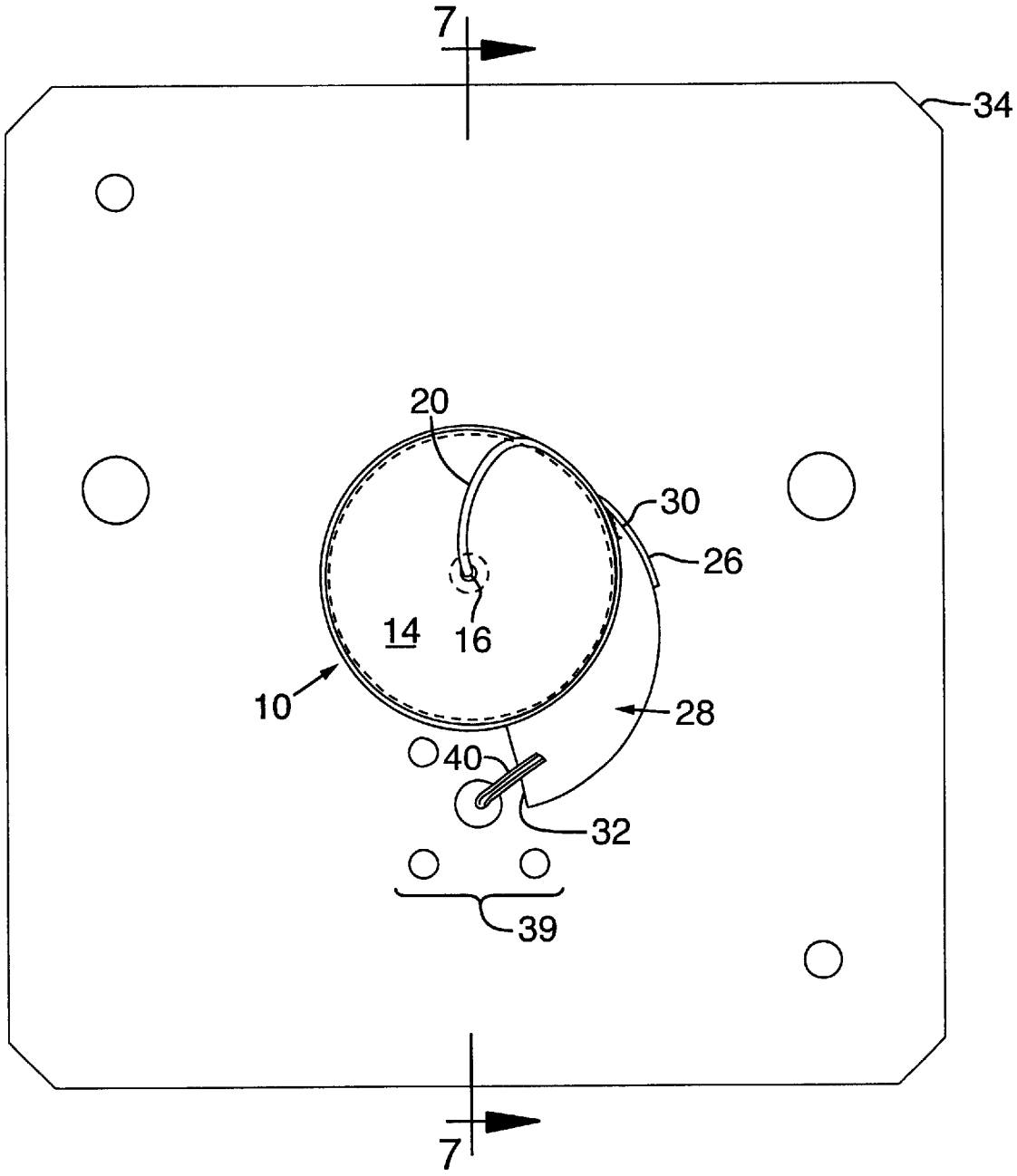
FIG. 5 is a top plan view of the helical antenna of FIG. 1.
Figure 6:
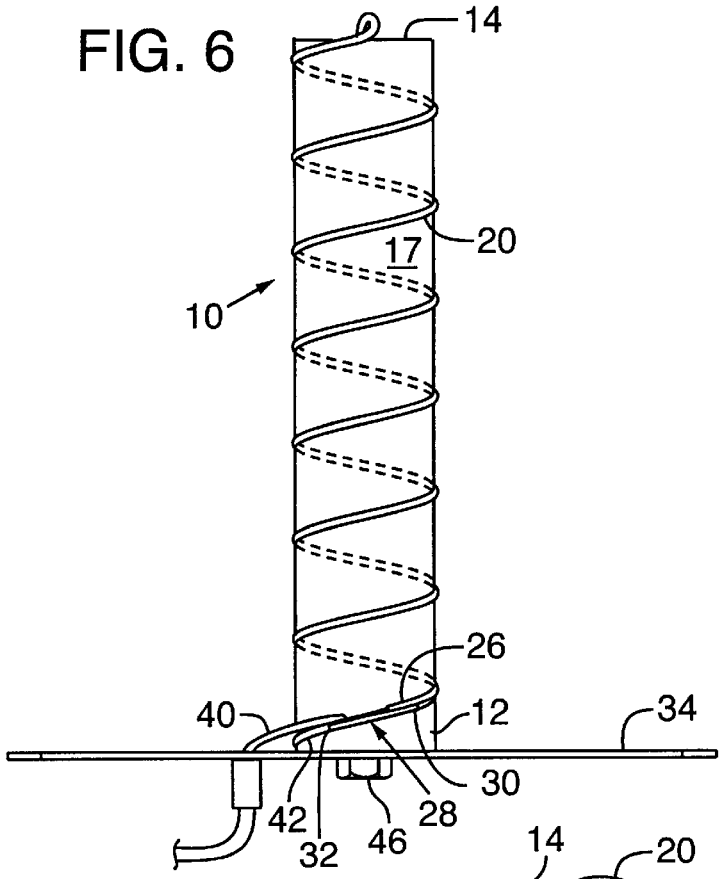
FIG. 6 is a side elevation view of the helical antenna of FIG. 1.

FIGS. 5 and 6 are respective top plan and side elevation views of helical antenna 8, of FIG. 1. With reference to FIGS. 5 and 6, elongate core 10 is attached to back plate 34. Radiating element 20 is wrapped around elongate core 10 in a helical shape. Preferably, radiating element 20 rests in helical groove 42. First end 22 is inserted into first hole 16 in distal end 14 of elongate core 10. Impedance matching section 28 is seated in helical groove 42 adjacent to proximal end 12 of elongate core 10. Narrow end 30 of impedance matching section 28 is connected to second end 26 of radiating element 20. Wide end 32 of impedance matching section 28 is positioned a predetermined distance from back plate 34 and is connected to connector 40. The predetermined distance is dependent upon the size of connector 40 employed in the antenna as well as the electrical properties of the matching section and the back plate. In a presently preferred embodiment of the invention, connector 40 is the central conducting element of a standard male N-type connector and the predetermined height is between 0.115 and 0.145 inches (0.292 and 0.368 cm).

In a presently preferred embodiment, second end 26 of radiating element 20 connects to a portion of narrow end 30 of impedance matching section 28, such that second end 26 of radiating element 20 overlaps the portion of outer margin 46 of impedance matching section 28. Second end 26 is preferably connected to the portion of outer margin 46 of impedance matching section 28, by soldering second end 26 and the portion of outer margin 46 together. Wide end 32 is preferably connected to connector 40, by soldering connector 40 and wide end 32 together. In this embodiment, impedance matching section 28 is rigidly secured into helical groove 42 such that wide end 32 is positioned a predetermined distance from back plate 34.

Figure 7:
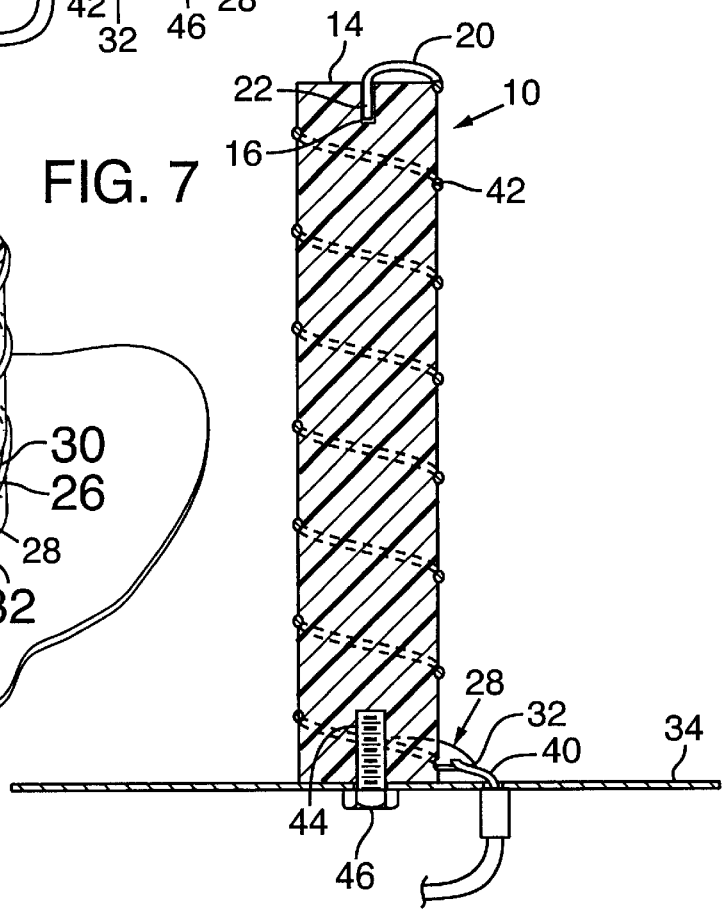
FIG. 7 is a cross sectional view of the helical antenna of FIG. 1 taken along line 7—7 of FIG. 5.

FIG. 7 is a cross sectional view of helical antenna 8 of FIG. 1 taken along lines 7—7 of FIG. 5. With reference to FIG. 7, elongate core 10 further comprises a second hole 44 a proximal end 12. A screw 46 attaches elongate core 10 to back plate 34. As shown in other views, radiating element 20 is wrapped around elongate core 10 in a helical fashion. First end 22 of radiating element 20 is inserted into first hole 16 in distal end 14 of elongate core 10. Second end 26 of radiating element 20 is connected to narrow end 30 of impedance matching section 28. Impedance matching section 28 is seated in helical groove 42 such that wide end 32 is a predetermined distance from back plate 34. Wide end 32 of impedance matching section 28 is connected to connector 40.

Figure 8:
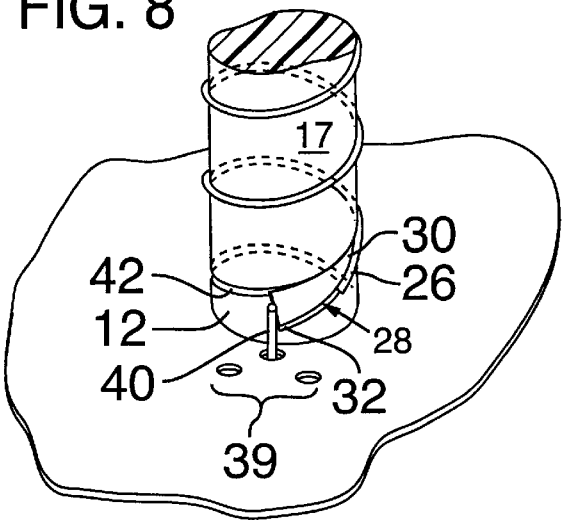
FIG. 8 is an enlarged partial perspective view of a proximal end of the helical antenna of FIG. 1 showing the impedance matching section connected to an electrical connector.

FIG. 8 is an enlarged partial perspective view of proximal end 12 of helical antenna 8 of FIG. 1 showing impedance matching section 28 connected to connector 40. With reference to FIG. 8, wide end 32 of impedance matching section 28 is spaced a predetermined distance from back plate 34. Wide end 32 of impedance matching section 28, is positioned over the center of hole arrangement 39, such that connector 40 is perpendicular to back plate 34. Connector 40 is soldered to wide end 32 of matching section 28.

It will be obvious to those having skill in the art that many changes may be made to the details of the above-described embodiments of this invention without departing from the underlying principles thereof. The scope of the present invention should, therefore, be determined only by the following claims.

What is claimed is:

1. A circularly polarized helical antenna comprising:

an elongate core formed of a substantially rigid dielectric material having a proximal end, a distal end, an exterior major surface, and a helical groove extending over at least a portion of the exterior major surface;

a radiating element formed of an electrically conductive material and formed into a generally helical shape and positioned generally surrounding the elongate core, the radiating element terminating at a first end positioned adjacent the distal end of the elongate core and at a second end positioned adjacent the proximal end of the elongate core, the radiating element having a first electrical impedance; and an impedance matching section formed of a substantially rigid, electrically conductive material, the impedance matching section having a narrow end and a wide end, the narrow end being electrically and mechanically connected to the second end of the radiating element, the wide end adapted for connection to an electrical connector, the impedance matching section having a second electrical impedance at the narrow end for matching the first electrical impedance of the radiating element and having a third electrical impedance at the wide end for matching a fourth electrical impedance of the electrical connector, in which the impedance matching section is seated in the helical groove on the elongate core at a point adjacent to the proximal end of the elongate core.

2. The antenna of claim 1, further comprising a back plate attached to the proximal end of the elongate core and in which the wide end of the impedance matching section spaced a predetermined distance from the back plate.

3. The antenna of claim 1 in which the elongate core has a dielectric constant of 3.6.

4. The antenna of claim 3 in which the helical groove includes a pitch angle of between 12 degrees and 13 degrees.

5. The antenna of claim 4 in which:

the elongate core has a length that corresponds to a helix with 7 turns, with a flight spacing ranging from 0.861 inches to 0.871 inches along the length of the elongate core; and the elongate core has a diameter of between 1.2 and 1.3 inches.

6. The antenna of claim 1 in which the helical groove has a width and the radiating element is formed of a predetermined length of copper wire, the copper wire having a diameter sized less than the width of the helical groove such that the copper wire fits at least partially within the helical groove.

7. The antenna of claim 1 in which the radiating element comprises copper wire and the first electrical impedance is 110 ohms.

8. The antenna of claim 7 in which the impedance matching section is made of copper, the second electrical impedance is 110 ohms, and the third electrical impedance is 50 ohms.

9. The antenna of claim 7 in which the impedance matching section has a thickness between 0.02 and 0.03 inches, an inner radius between 0.620 and 0.630 inches, and an outer radius between 0.745 and 0.755 inches.

10. A circularly polarized monofilar helical antenna for use in wireless communications comprising:

an elongate core having a length, a distal end, a proximal end, an exterior major surface, and a helical groove in the exterior major surface extending between the proximal and the distal ends;

an electrically conductive radiating element having a first end, a second end, and a first electrical impedance, the radiating element resting in the helical groove in the exterior major surface of the elongate core, the first end terminating adjacent to the distal end of the elongate core and the second end terminating adjacent to the proximal end of the elongate core;

a back plate attached to the proximal end of the elongate core; and an impedance matching section that has a narrow end, a wide end, and a shape, the shape comprising the area between an inner arcuate margin and an outer margin, the outer margin flaring from the narrow end of the impedance matching section to the wide end of the impedance matching section, such that the narrow end has a second electrical impedance for matching the first electrical impedance of the radiating element and is connected to the second end of the radiating element, and such that the wide end is adapted for connecting to an electrical connector end has a third electrical impedance for matching an electrical impedance of the electrical connector, in which the inner arcuate margin of the impedance matching section is seated in the helical groove adjacent to the point at which the impedance matching section is connected to the second end of the radiating element.

11. The antenna of claim 9 in which the elongate core has a dielectric constant of 3.6.

12. The antenna of claim 10 in which the first impedance and the second impedance are 110 ohms and the third impedance is 50 ohms and the impedance matching section is a predetermined distance from the back plate.

* * * * *